United States Patent [19]

Tsumura et al.

[11] Patent Number: 5,027,869

[45] Date of Patent: Jul. 2, 1991

[54] DISPENSING METHOD AND APPARATUS, AND CONTAINER TRANSPORTING APPARATUS

[75] Inventors: Takashi Tsumura, Osaka; Yasuharu Kawasaki, Nishinomiya; Toshihiro Terada, Osaka, all of Japan

[73] Assignee: Kurashiki Boseki Kabushiki Kaisha, Okayama, Japan

[21] Appl. No.: 426,708

[22] Filed: Oct. 26, 1989

[30] Foreign Application Priority Data

Oct. 26, 1988 [JP] Japan ..... 63-270263
Aug. 14, 1989 [JP] Japan ..... 1-210505

[51] Int. Cl.[5] ..... B65B 3/04; B65B 43/54

[52] U.S. Cl. ..... 141/104; 141/9; 141/129; 141/169; 141/174; 198/465.2; 198/774.1; 269/309

[58] Field of Search ..... 198/345, 465.2, 465.3, 198/465.1, 803.01, 803.2, 774; 269/67, 68, 69, 309

[56] References Cited

U.S. PATENT DOCUMENTS

| | | | |
|---|---|---|---|
| 2,975,809 | 3/1961 | Ninneman et al. | 141/1 |
| 3,040,604 | 6/1962 | Benton | 269/69 |
| 3,349,815 | 10/1967 | De Baets | 141/104 |
| 3,524,295 | 8/1970 | Spaulding . | |
| 3,707,173 | 12/1972 | Lewis | 141/104 |
| 3,730,235 | 5/1973 | Lewis | 141/172 |
| 4,014,428 | 3/1977 | Ossbahr | 198/345 |
| 4,077,444 | 3/1978 | Gilson et al. . | |
| 4,147,250 | 4/1979 | Schulz | 198/465.2 |
| 4,355,938 | 10/1982 | Page | 198/345 X |
| 4,390,172 | 6/1983 | Gotman | 269/309 X |
| 4,503,964 | 3/1985 | Kampf et al. | 198/465.2 X |
| 4,628,974 | 12/1986 | Meyer | 141/129 |
| 4,669,607 | 6/1987 | Mason | 198/774 |
| 4,725,182 | 2/1988 | Sakamoto et al. | 198/465.1 X |
| 4,783,889 | 11/1988 | Hayashi | 198/774 X |
| 4,850,470 | 7/1989 | Ferkany | 198/345 |

FOREIGN PATENT DOCUMENTS

| | | |
|---|---|---|
| 2710085 | 9/1978 | Fed. Rep. of Germany . |
| 2922308 | 12/1979 | Fed. Rep. of Germany . |
| 1560752 | 3/1976 | United Kingdom . |

*Primary Examiner*—Ernest G. Cusick
*Attorney, Agent, or Firm*—Wenderoth, Lind & Ponack

[57] ABSTRACT

A method and apparatus for pouring a plurality of materials into a plurality of containers while sequentially weighting the materials. A predetermined number of containers are arranged in a row on a pallet so that the containers are transported by a pallet as a unit. In order to pour the materials into the containers, the pallet carrying the containers is intermittently moved in a longitudinal direction by a distance corresponding to a distance between adjacent containers, and the materials are poured into the respective containers when the pallet stops with the containers at respective pouring positions. The pallet is transported in a transverse direction so as to arrange it to allow pouring of the materials into the containers and so as to discharge the pallet towards a discharge section.

4 Claims, 6 Drawing Sheets

DISPENSING METHOD AND APPARATUS, AND CONTAINER TRANSPORTING APPARATUS

BACKGROUND OF THE INVENTION

1. Field of the Invention

The present invention relates to a dispensing apparatus and a method for automatically sequentially measuring and pouring a plurality of materials such as dyestuffs into a plurality of containers so as to dispense the materials, and also a container transporting apparatus, to be used with the dispensing apparatus, for transporting the containers when the materials are poured into each of the containers.

2. Description of the Related Art

In prior art devices, a circular turntable is used in a dispensing apparatus for automatically weighing materials and pouring them into containers. Through holes for receiving cup-shaped containers are formed in the vicinity of the periphery of the turntable such that they are spaced at regular intervals around the circumference. The containers are fitted in the through holes and transported with the rotation of the turntable. A device, such as a nozzle, for pouring the materials into the containers is disposed above the turntable so that the device coincides with the through holes formed in the periphery thereof. A container is supplied to one of the through holes of the turntable prior to the through hole being rotated to a pouring position. The container into which the materials have been poured at the pouring position is taken out of the turntable after the container passes the pouring position.

Such a dispensing apparatus which transports containers by use of a turntable, as described above, is such that the number of containers to be treated simultaneously is less than the number of through holes formed around the circumference of the turntable. Further, since the through holes are formed in the vicinity of the periphery of the turntable, the center of the turntable and the vicinity thereof cannot be effectively utilized as a container transporting path. Thus, a compact apparatus cannot be manufactured.

In addition, the operation of the apparatus is inefficient because it is necessary to supply vacant containers to the turntable and to individually remove therefrom containers filled with material.

SUMMARY OF THE INVENTION

Accordingly, an essential object of the present invention is to provide a compact dispensing apparatus in which the operation for supplying and discharging containers can be efficiently carried out.

According to one preferred embodiment, the following method for dispensing materials is provided. The method for dispensing a plurality of materials comprises the steps of transporting vacant dispensing containers to a position to for pouring of the plurality of materials to be weighed into said vacant dispensing containers; pouring the plurality of materials, different amounts of which are predetermined, into the containers at the pouring position; and discharging the containers into which the plurality of materials has been poured at the pouring step so as to collect the containers. The method is characterized in that the containers are transported by a pallet on which a predetermined number of containers are arranged in a row. In the pouring step, the plurality of materials are poured into the container at predetermined stop positions while the pallet carrying the containers is intermittently transported by a predetermined distance (pitch distance) corresponding to a distance between adjacent containers in a longitudinal direction. During the container supply step and the container discharge step, the pallet is moved in a transverse direction.

According to the above-described method, the pallet carrying a plurality of containers into which materials have been poured moves along the transporting path. During the pouring step for pouring materials into each of the containers, the pallet is intermittently moved in the longitudinal direction by the pitch distance and all materials are sequentially poured into each of the containers at respective stop positions. In the pouring step, the pallet is moved along the transporting path in the longitudinal direction by the pitch distance so that all materials are sequentially poured into respective containers. In the other steps, namely, in the supply and discharge steps, a plurality of containers are placed on the pallet and transported together along the transporting paths in the transverse direction. Thus, many containers can be disposed along the respective paths.

According to another preferred embodiment of the present invention, a dispensing apparatus (to be described below) is provided. The dispensing apparatus has a pouring section for pouring a plurality of materials into vacant containers so as to dispense the materials; a supply section for transporting the vacant containers so as to supply vacant containers to the pouring section; and a discharge section for transporting the containers which have been discharged from the pouring section after the plurality of materials have been poured into the containers. The dispensing apparatus is characterized in that a pallet on which a predetermined plural number of containers are arranged in a row is transported to the respective sections with the plural number of containers treated as a unit. The pouring section comprises transporting means for intermittently moving the plural number of containers carried by the pallet by a predetermined pitch distance in a longitudinal direction; and pouring means for pouring the plurality of materials into the containers at predetermined stop positions while the pallet is being intermittently transported by the transporting means. The supply section and discharge section include transporting means for moving the pallet in a transverse direction.

According to the above-described dispensing apparatus, a plurality of containers arranged in a row on the pallet are transported. That is, the plural number of containers are transported as a unit. Therefore, this method for transporting the containers contributes to the efficient operation for supplying the containers to the apparatus and discharging them therefrom. In the supply and discharge sections, the pallet is transported in the transverse direction. That is, many containers can be handled per operation, which allows the apparatus to be compact. If the containers are moved in the pouring section in this manner, namely in the transverse direction, all the materials are required to be simultaneously poured into all the containers placed on the pallet. To provide for this it would normally be necessary to provide a number of material pouring/weighing mechanisms corresponding to the number of containers. As such, the space occupied by the material pouring-/measuring mechanisms is great with respect to the whole space of the apparatus. According to the apparatus of the present invention, however, while the containers are intermittently moving forward in the longitudinal direction by the pitch distance, respective materials are sequentially poured into containers at respective material pouring positions. Thus, the provision of one pouring/measuring apparatus makes the dispensing apparatus compact.

According to still another preferred embodiment, the following dispensing apparatus is provided. In the dispensing apparatus, the supply section communicates with a stock section for sequentially moving the pallets in three dimensions with the pallets supported horizontally. The discharge section communicates with an indication section for indicating on the container the classification of the plurality of materials poured thereinto and a stirring section for stirring the plurality of the materials poured into the containers.

According to the above-described dispensing apparatus, the stock section is provided forward of the supply section in order to sequentially move containers in three dimensions while supporting the pallet horizontally. Thus, many containers stocked in a small space are transported to the pouring section by means of the transporting means provided with the supply section. Since the indication and the stirring section are additionally provided forward of the discharge section, all of the operations including stocking, pouring, weighing, labeling and stirring can be performed in a single apparatus. That is, many vacant containers can be stocked with the containers placed on the pallet, and the pallets can be sequentially transported to the pouring section by the transporting means of the supply section in the transverse direction. The pallets are transported from the supply section to the pouring section with the pallet placed on the pallet in the longitudinal direction. In the pouring section, respective materials are sequentially poured into each of the containers at respective stop positions while the pallet is intermittently moved by the pitch distance. When the pouring of respective materials into all the containers carried by the pallet has been completed, the pallet is transported from the pouring section to the discharge section in the transverse direction so that the containers are collected in the discharge section. While the containers are passing through the stirring section, the materials poured into the containers are stirred by the stirring means so as to uniformly mix the materials with each other. When the containers are passing through the indication section, information such as the kind and weight of materials poured into the containers is indicated on the containers. Thus, the containers are collected.

According to a further embodiment, the following container transporting apparatus is provided. The container transporting apparatus comprises pallet transporting means for transporting a pallet carrying a plurality of containers thereon in a row; pallet transportation drive means for transporting the pallet transporting means forward and backward alternately in a longitudinal direction; and guide means for guiding the pallet transporting means driven by the pallet transportation drive means to forwardly advance the pallet intermittently such that the pallet transporting means supports and engages the pallet from below and transports the pallet forward when the pallet transporting means is moved forward by the pallet transportation drive means, while the pallet transporting means moves downward from the pallet and moves backward when the pallet transporting means is moved backward by the pallet transportation drive means. Accordingly, the pallet is transported by the pitch distance during each cycle of movement of the pallet transporting means.

In the above construction of the container transporting apparatus, it is preferable that the pallet has a C-shaped section including a pair of opposite lower end faces, and upper face and a pair of opposite side faces connecting the upper face with the lower end faces, each end face having first engaging means. It is also preferable that the pallet transporting means comprises two bar-shaped members parallel with each other and confronting the lower end face of the pallet, each bar-shaped member having second engaging means to be associated with the first engaging means and projections projecting laterally from an outer side face thereof. The guide means comprises a pair of guide groove members respectively arranged laterally of the corresponding bar-shaped members, each having a guide groove in which the projections of the bar-shaped members are inserted. Each of the guide groove members includes a partitioning wall extending longitudinally in the guide groove to form an upper section and lower section, and pivot means provided on both ends of the partitioning wall along the longitudinal direction thereof. The pivot means are vertically pivotal so that the projections move forward in the guide groove slidably on an upper face of the partitioning wall when the bar-shaped members are moved forward by the pallet transportation drive means, while the projections move backward below the partitioning wall in the guide groove when the bar-shaped members are moved backward. The pallet transportation drive means comprises an actuator which removably engages a bridge connected between the two bar-shaped members so that the actuator engages the bridge to move the bar-shaped members forward when the actuator moves forward. The actuator is disengaged from the bridge when the actuator reaches a forward end of a moving stroke thereof. A screw shaft extends through the actuator so as to reciprocate the actuator in the pallet transporting direction, and a motor is provided for reversibly rotating the screw shaft.

In the container transporting apparatus, a hanger disposed below the pallet moves vertically and horizontally. When the pallet transporting means moves upward, it engages the pallet and, when the pallet transporting means moves downward, it disengages from the pallet. The pallet is moved in the longitudinal direction due to the horizontal movement of the pallet transporting means. The distance of the horizontal movement of the pallet transporting means corresponds to the pitch between adjacent containers. When the pallet transporting means which has engaged the pallet moves forward, the pallet moves forward as well, whereby the container is moved forward by the pitch distance in the longitudinal direction. Thereafter, the pallet transporting means moves downward, i.e., it disengages from the pallet transporting means. Then, the pallet transporting means moves backward so as to move the next container by the pitch distance. The guide means guides the pallet transporting means so that the pallet transporting means moves vertically or horizontally. The pallet transportation drive means drives the pallet transporting means horizontally while also allowing vertical movement thereof. According to this mechanism, the provision of one pouring means is enough for the apparatus to perform its function. A plurality of materials can be poured into one container when the container is disposed at the respective pouring positions while containers are intermittently moved by the pallet transporting means. Accordingly, the pouring/weighing mechanisms and the pouring section of the dispensing apparatus can be made compact in the same manner as the supply and discharge sections.

BRIEF DESCRIPTION OF THE DRAWING

This and other objects and features of the present invention will become apparent from the following description in conjunction with the preferred embodiments thereof with reference to the accompanying drawing, in which.

DETAILED DESCRIPTION OF THE INVENTION

Figure 1:
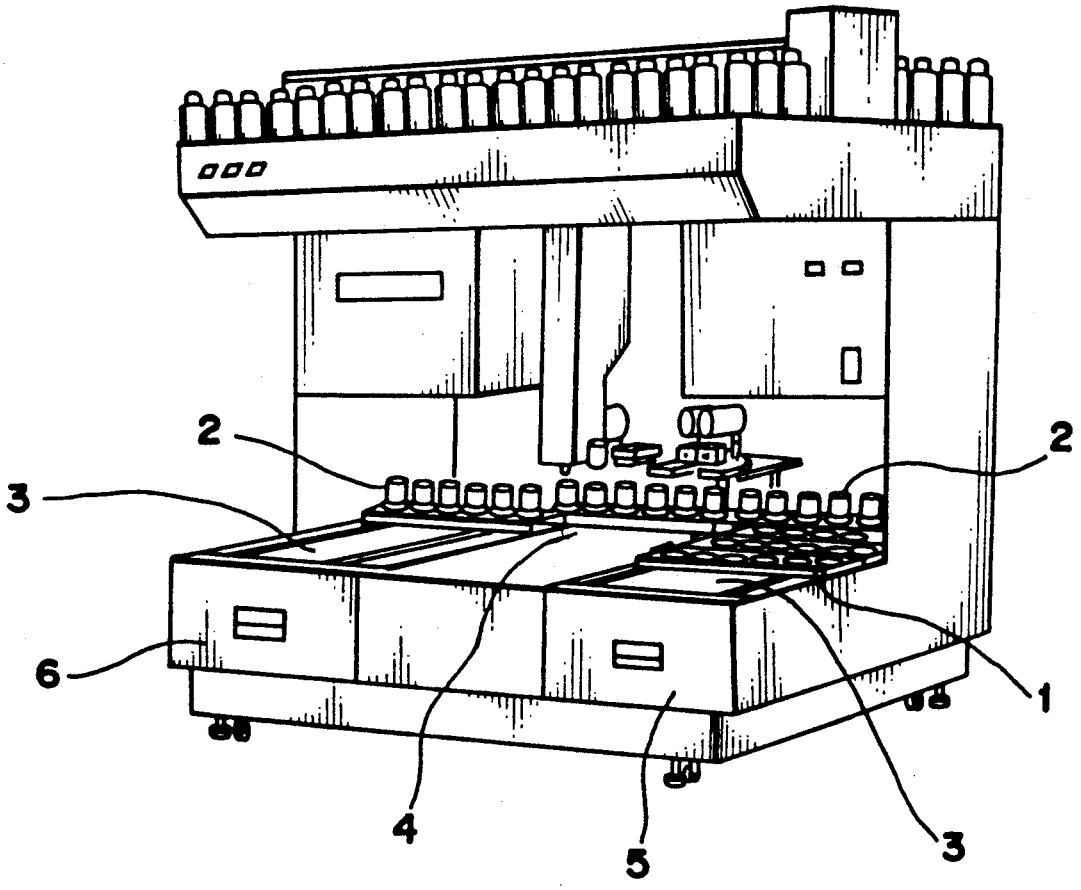
FIG. 1 is a perspective view showing schematically a dispensing apparatus according to a first embodiment of the present invention.

Before the description of the present invention proceeds, it is to be noted that like parts are designated by like reference numerals throughout the accompanying drawings.

Referring now to the drawings, preferred embodiments are described hereinafter.

FIG. 1 is a perspective view schematically showing the construction of a dispensing apparatus (hereinafter referred to as an apparatus) of a first embodiment in accordance with the present invention. According to the first embodiment, six containers 2 are arranged on one pallet 1 in a row so that six containers 2 can be simultaneously transported as a transportation unit. A path 3 comprises two sections disposed respectively on the right and left sides of the apparatus which extend from the front thereof to the back thereof in a direction at a right angle to the row of containers 2, and a section which spans a pouring section 4 from the right side thereof to the left side thereof in the longitudinal direction of the row of containers. The apparatus comprises a supply section 5 disposed on the right side thereof which extends from the front to the back of the apparatus, a discharge section 6 disposed on the left side of the apparatus and which extends from the front to the back of the apparatus, and the pouring section 4 disposed between the supply section 5 and the discharge section 6. Standing in front of the apparatus, an operator sets the pallet 1 carrying six vacant containers 2 on the front of the supply section 5. The pallet 1 set on the supply section 5 moves from the front of the apparatus to the back thereof in the direction normal to the row of containers (i.e. in the longitudinal direction). The pallet 1, after having arrived at the back of the supply section 5, is transported in the longitudinal direction to the pouring section 4 disposed adjacent to the left side of the supply section 5 and in the center of the apparatus. While the pallet 1 moves across the pouring section 4, the pallet 1 intermittently moves in the longitudinal direction. That is, the pallet 1 moves by a distance corresponding to a distance between centers of adjacent ones of through holes 13 (this distance will be hereinafter referred to as "pitch"), namely, between adjacent containers 2. Thereafter, the pallet 1 stops at a predetermined position so that a predetermined amount of a material, such as a dyestuff, can be poured into respective containers 2 while the predetermined amount of the material is measured. Thus, the pallet 1 is alternately moved forward and stopped (during pouring). After all the materials contained in respective tanks disposed above the pallet 1 are poured into the container 2, the pallet 1 continues the intermittent forward movement in the longitudinal direction until it reaches the discharge section 6 adjacent to the left side of the pouring section 4. Thereafter, the pallet 1 carrying the six containers 2 moves toward the front of the apparatus in a direction at a right angle to the longitudinal direction (i.e. in a transverse direction). Standing in front of the discharge section 6, the operator removes the pallet 1.

Figure 2:
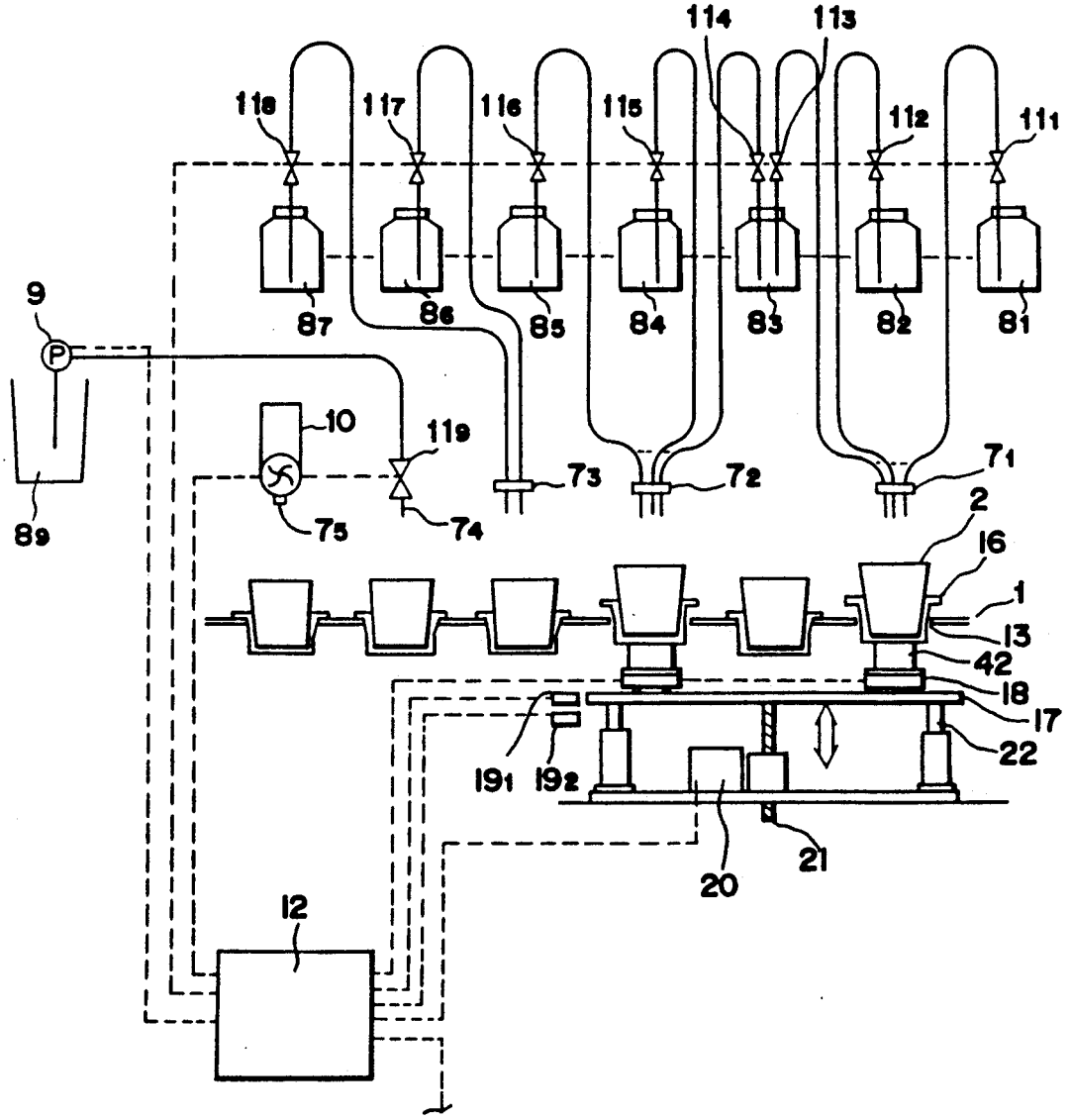
FIG. 2 is an illustration showing schematically the construction of a pouring/weighing mechanism of a pouring section of the dispensing apparatus as shown in FIG. 1.
Figure 3:
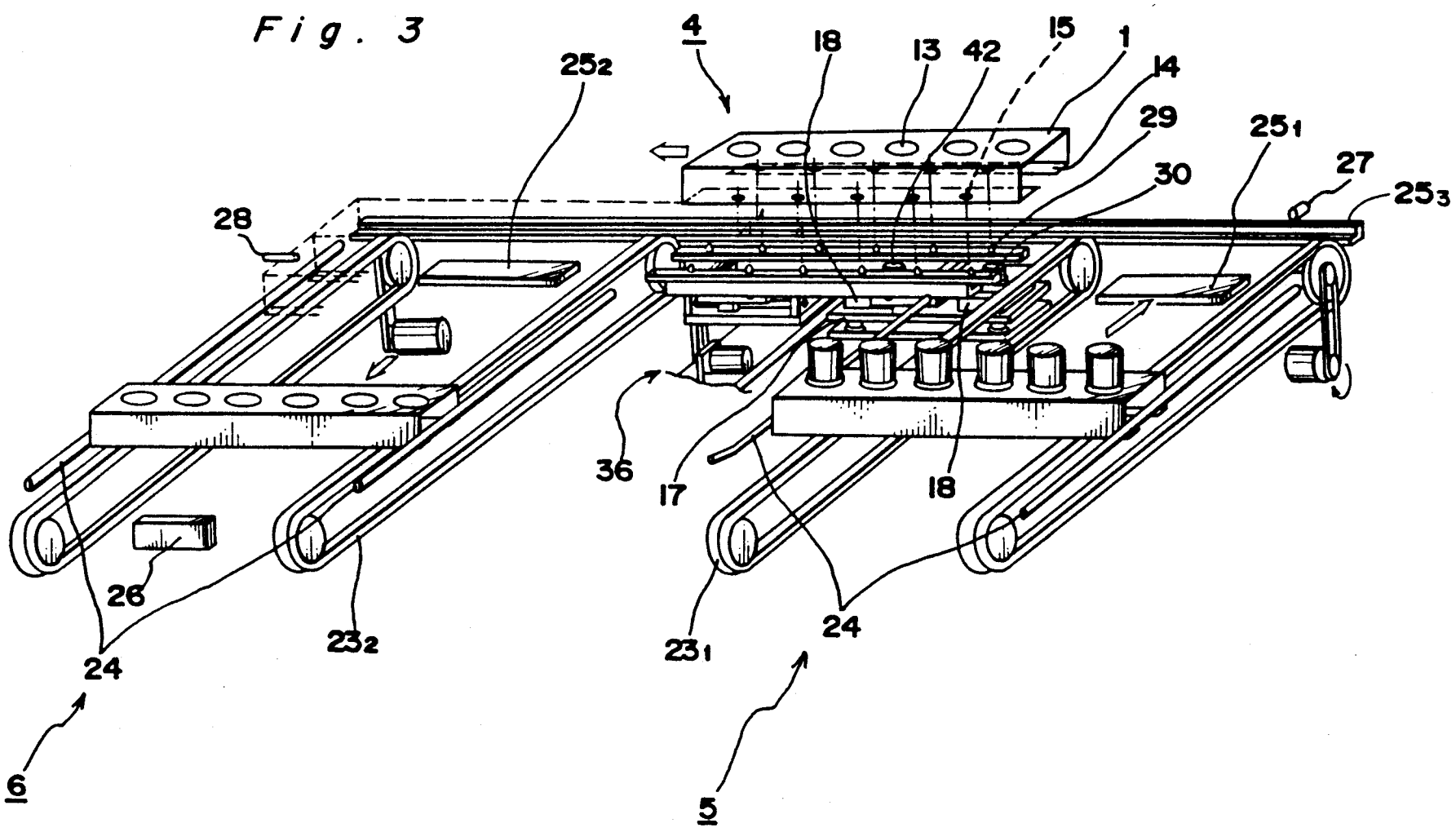
FIG. 3 is a perspective view showing schematically a container transporting apparatus included in the above dispensing apparatus.

FIG. 2 schematically shows the mechanism of the pouring section 4 for pouring and measuring materials. According to this embodiment, a plurality of dyestuffs, an auxiliary agent, water, paste, and an auxiliary powder agent are poured into a container 2 such that these materials can be mixed with each other and weighed. The pouring section 4 includes on the upper portion thereof first through fifth nozzles $7_1$ through $7_5$. The first through fifth nozzles $7_1$–$7_5$ are disposed at positions corresponding respectively with positions at which the containers 2 stop so that materials can be poured from the nozzles $7_1$ through $7_5$ thereinto. Each of the tanks $8_1$ through $8_7$ shown in the upper portion of FIG. 2 contains a material. Each of the first tank $8_1$ through the fifth tank $8_5$ contains a dyestuff. The sixth tank $8_6$ contains water. The seventh tank $8_7$ contains an auxiliary agent. The dyestuffs are supplied from the first tank $8_1$ through the third tank $8_3$ to the first nozzle $7_1$. The dyestuffs contained in the third tank $8_3$ through the fifth tank $8_5$ are supplied to the second nozzle $7_2$. Since the period for pouring a dyestuff is longer than the periods for pouring other materials, the dyestuff contained in the third tank $8_3$ is supplied to both the first nozzle $7_1$ and the second nozzle $7_2$. Thus, the dyestuff pouring period can be reduced. Water contained in the sixth tank $8_6$ and the auxiliary agent contained in the seventh tank $8_7$ are supplied to the third nozzle $7_3$. A viscous paste is supplied from the paste stock tank $8_9$ to the fourth nozzle $7_4$ by means of a fixed displacement pump 9. An auxiliary powder agent is supplied from a fixed displacement feeder 10 to the fifth nozzle $7_5$. Each of the fourth nozzle $7_4$ and the first tank $8_1$ through the seventh tank $8_7$ is provided with a flow rate adjusting electromagnetic valve $11_1$ through $11_9$, respectively. A control section 12, in which the amounts of respective materials to be poured is set, outputs signals to control the opening, closing, drives, and stops of the electromagnetic valves $11_1$ through $11_9$, the pump 9, and the feeder 10. As stated previously, six through holes 13 for receiving the containers 2 are formed in the pallet 1 at regular intervals along a row The intervals define the pitch between respective adjacent holes 13, as described previously. As shown in FIG. 3, the pallet 1 has an approximately C-shaped transverse cross section. That is, both of the lower side portions thereof are bent inward so that the bent portions are parallel with the upper face thereof, thus forming inner flanges 14. Positioning holes are defined in the inner flanges 14 such that the holes 15 are spaced at the same intervals as the intervals between the adjacent holes 13, namely, the pitch between adjacent containers 2. Referring again to FIG. 2, the size and configuration of the container 2 are determined by the kind of materials to be poured thereinto. Adaptors 16 supported by the upper face of the pallet 1 are inserted into the holes 13 in order to place each of the containers 2 in the same condition irrespective of the configuration thereof. It is to be noted that the distance between the bottom face of each of the adaptor 16 and the upper face of the pallet 1 is constant. When the adaptor 16 is pushed upward, the adaptor 16 is moved away from the pallet 1. As a result, the weight of the adaptor 16 is applied to a pushing means. Thus, supposing that the pushing means is a weighing instrument, each of the containers 2 can be weighed in the same condition. Weighing instruments 18 disposed below the first nozzle $7_1$ and the second nozzle $7_2$ are mounted on a table 17 disposed vertically movably below the pouring section 4. When the containers 2 transported by the pallet 1 are disposed directly below the first nozzle $7_1$ and the second nozzle $7_2$ and above the weighing instrument 18, the table 17 moves upward, thus pushing the container 2 upward. While the dyestuffs are being poured into the containers 2, the dyestuff is weighed in this condition. A signal indicative of the weight of the dyestuff is outputted to the control section 12. In response to the signal, signals for controlling the openings and closings of the electromagnetic valves $11_1$ through $11_6$ provided with the tanks $8_1$ through $8_5$ are outputted from the control section 12. The mechanism for pouring the materials and weighing them comprises a sensor $19_1$ for detecting the condition in which the table 17 has been disposed at the uppermost position, a sensor $19_2$ for detecting the condition in which the table 17 has been disposed at the lowermost position, a motor 20 and a screw shaft 21 for moving the table 17 upward and downward, a guide shaft 22 for guiding the table as it is moved upward and downward, and a spacer 42 disposed between the adaptor 16 and the weighing instrument 19. Signals are also outputted from sensors (not shown) and motors (not shown) provided with mechanisms connected with the supply section 5 and the discharge section 6.

Figure 4:
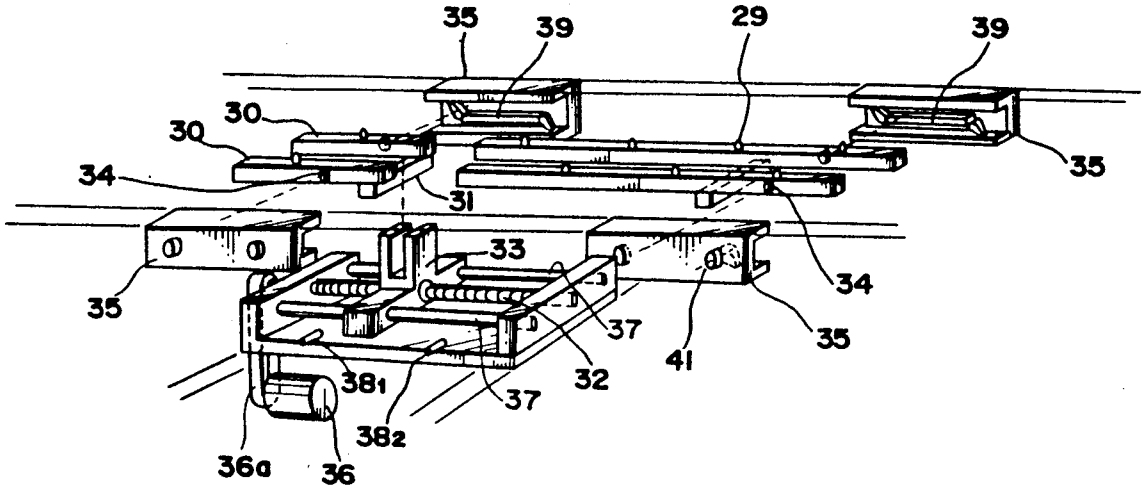
FIG. 4 is a perspective view showing schematically the construction of an essential part of the above container transporting apparatus.
Figure 6:
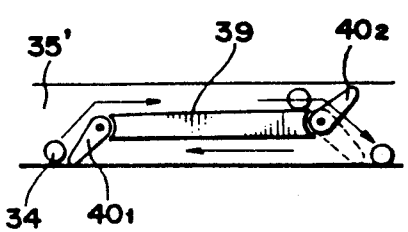
FIG. 6 is an illustration showing operations of the roller follower and the claw to be performed by the container transporting mechanism shown in FIG. 4 as the hangers are being moved backward.
Figure 5:
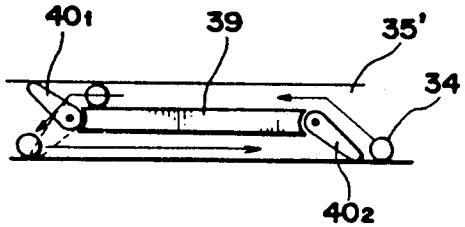
FIG. 5 is an illustration showing operation of a roller follower and a claw to be performed by the container transporting mechanism shown in FIG. 4 as hangers are being moved forwardly.
Figure 7:
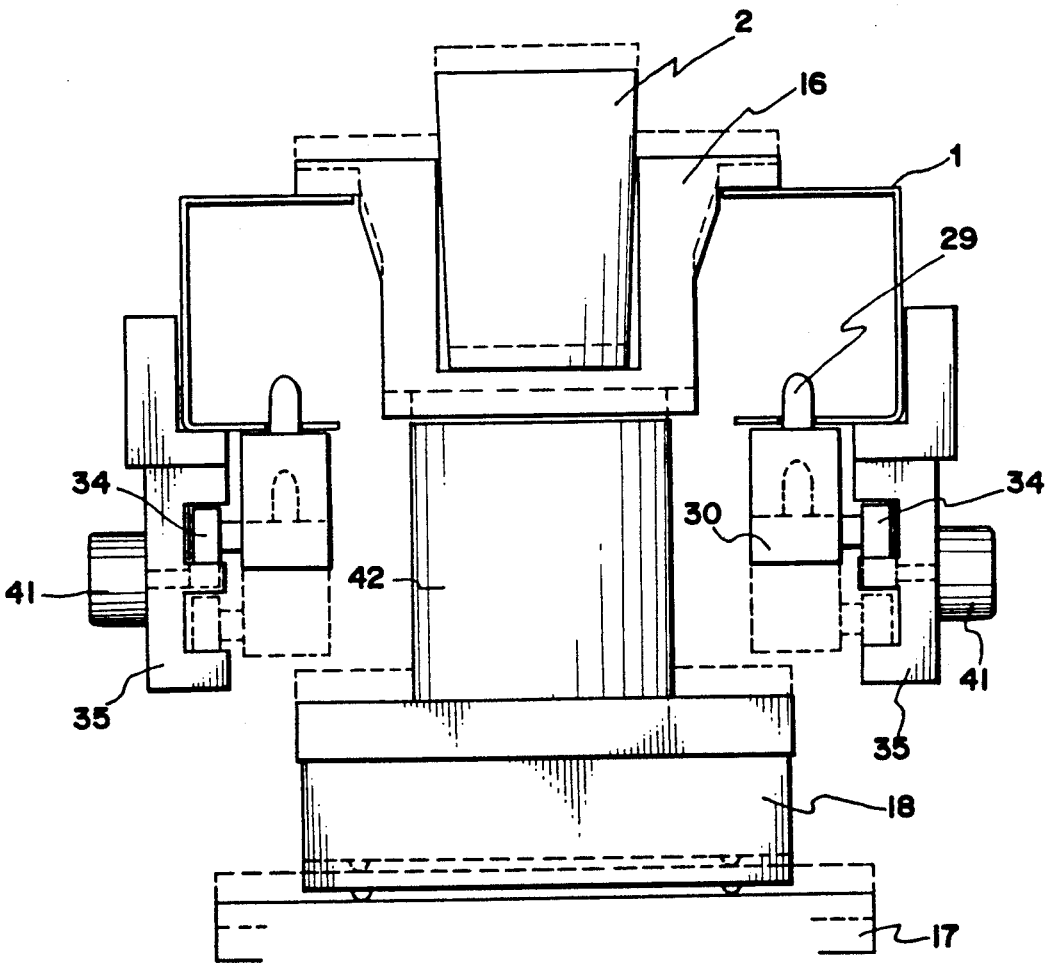
FIG. 7 is a partial sectional view showing a container transporting mechanism and a weighing mechanism in the vicinity of a weighing instrument of the dispensing apparatus.

FIG. 3 is a view schematically showing the construction of a container transporting apparatus included in the dispensing apparatus in accordance with the present invention. FIG. 4 shows schematically the construction of a mechanism of the container transporting apparatus for transporting containers 2 by the distance of the pitch. FIG. 5 shows the operation of the roller follower and the claw of the mechanism for transporting a container by the pitch distance when the roller follower moves forward and the claw is urged to rotate clockwise. FIG. 6 shows the operation of the roller follower and the claw of the mechanism for transporting the container by the pitch distance when the roller follower moves backward and the claw is urged to rotate counterclockwise. FIG. 7 is a partial sectional view showing a container transporting mechanism and a weighing mechanism of a weighing instrument of the dispensing apparatus in accordance with the present invention.

Each of the supply section 5 and the discharge section 6 includes a pair of conveyor chains $23_1$ and $23_2$, respectively, which supports and transports the pallet 1. The conveyor chains $23_1$ of the supply section 5 rotate in the direction in which the pallet 1 is transported from the front of the apparatus to the back thereof and the conveyor chains $23_2$ of the discharge section 6 rotate in the direction in which the pallet 1 is transported from the back of the apparatus to the front thereof. A guide rod 24 for guiding the movement of the pallet 1 is disposed on each side of each of the pairs of the conveyor chains $23_1$ and $23_2$, respectively. There are provided, to the rear of the conveyor chains $23_1$ and $23_2$, pallet transporting guides $25_1$ through $25_3$ for receiving the pallet 1 from the pouring section 4 and transporting the pallet 1 from the pouring section to the discharge section 6. In the supply section 4, the conveyor chains $23_1$ are stopped when the pallet 1 comes into contact with the pallet transporting guide $25_3$. The supply section 4 includes a sensor 27 which detects the presence of the pallet 1 so as to control the movement of a hanger 30 which will be described later. The pallet 1 is stopped by a pallet stopper 26 provided at a front end of the discharge section 6 when the pallet 1 is brought into contact with the pallet stopper 16. When the sensor 27 detects the presence of the pallet, it outputs a signal to the control section 12 which, in turn, causes the hanger 30 to be driven. When a sensor 28 detects that the discharge section 6 is full of the pallets 1, the sensor 28 outputs a signal to the control section 12 which then prevents the transportation of the pallet 1 to the discharge section 6.

The pouring section 4 includes a mechanism for transporting the pallet 1 by the pitch distance. This mechanism comprises the hanger 30 serving as a means for transporting the pallet 1. The hanger 30 comprises two parallel bars. In order to move the pallet 1 forward, the two bars of the hanger 30 contacts the inner flange 14 of the pallet 1 and thus supports the pallet 1. Pins 29 project from the upper face of the hanger 30 spaced at regular pitches. The hanger 30 removably engages the pallet 1 by alternately making vertical and horizontal movements, thus moving the pallet 1 intermittently. When the hanger 30 moves upward, the pins 29 fit into the openings 15 formed on the inner flange 14, thus ensuring the horizontal movement of the pallet 1. More specifically, the pins 29 are fitted into the openings 15 during the upward movement of the hanger 30, thus ensuring the horizontal movement of the pallet 1 during horizontal movements of the hanger 30. When the hanger 30 moves downward, the pins 29 disengage from the openings 15. Thus, the hanger 30 disengages from the pallet 1. A detailed description of this mechanism is made hereinbelow. As shown in FIG. 4, this mechanism essentially comprises a bridge 31 which connects the two bars of the hanger 30; an actuator 33, one end of which vertically slidably engages the bridge 31 and the other end of which has a screw shaft 32 extending therethrough so as to move the pallet 1 horizontally; roller followers 34 projecting from side faces of the hanger 30; and follower guide groove members 35 disposed along opposite sides of the bars of the hanger 30 so that the follower guide groove members 35 engage the roller followers 34. The follower guide groove members 35 serve as a means for guiding the pallet 1. The screw shaft 32 is driven by a belt 36a operatively connecting a motor 36 to one end of the screw shaft 32. The actuator 33 is horizontally moved according to the forward and reverse rotations of the screw shaft 32. That is, the pallet transporting means comprises the screw shaft 32, the actuator 33, and the motor 36 which are operatively connected to each other. The actuator 33 moves through a guide 37. Sensors $38_1$ and $38_2$ detect the amount of movement of the actuator 33 so as to control the motor 36. The hanger 30 moves forward and backward according to the forward and backward movements of the actuator 33. There is provided, in the follower guide groove 35' of each of the members 35, a block 39 extending in a longitudinal direction thereof and dividing the space in the follower guide groove 35' into upper and lower portions. Claws $40_1$ and $40_2$ are mounted on both ends of the block 39 in the longitudinal direction thereof so as to be pivotal around transversely extending axes. The claw $40_1$ disposed on the front of the hanger 30 is urged to pivot upward and the claw $40_2$ disposed on the back thereof is urged to pivot downward. As shown in FIG. 5, when the hanger 30 moves forward, the roller follower 34 slidably moves over the claw $40_2$ and travels forward in contact with the block 39. At this time, the pins 29 of the hanger 30 engage in the openings 15 of the pallet 1. In this condition, the hanger 30 moves forward by the pitch distance, thus transporting the containers 2 together with the pallet 1 by the pitch distance. When the hanger 30 has moved forward by the pitch distance, the roller follower 34 pushes down the pivot $40_1$, and thus arrives on the lower face of the follower guide groove 35'. At this time, the pins 15 of the hanger 30 disengage from the openings 15 of pallet 1. Thereafter, the hanger 30 is moved backward by the actuator 33. At this time, the roller follower 34 moves backward below the block 39 in the follower guide groove 35'. Then, the roller follower 34 pushes the claw $40_2$ upward, thus moving backward below the claw $40_2$. The materials are poured into the container 2 every time the pins 29 of the hanger 30 disengage from the openings 15. When the material contained in the first tank $8_1$ is poured into the container 2, the hanger 30 and the container 2 placed on the pallet 1 move by the pitch distance. Thus, the above-described operation is repeatedly performed until the materials contained in the tanks $8_1$ through $8_7$ are all poured into the six containers 2.

The description made above is concerned with the forward movement of the pallet 1 by means of the hanger 30, but there is a case in which it is necessary to move the pallet 1 backward by the pitch distance in order to adjust the amount of the material. To this end, the axes of the claws $40_1$ and $40_2$ are connected to a rotary solenoid 41 for reversing the claws $40_1$ and $40_2$ such that the rotary solenoid 41 is mounted on the outer face of the follower guide groove member 35. The rotation of the rotary solenoid 41 reverses the claws $40_1$ and $40_2$ against the urging force applied thereto. The pins 29 engage in the openings 15 of the pallet 1 when the hanger 30 is moving backward, and disengage therefrom when the hanger is moving forward by moving the actuator 33 backward while the claws $40_1$ and $40_2$ are pivoted to positions which are reversed relative to their normal position. Thus, the hanger 30 can be moved in a reverse direction, whereby the container 2 placed on the pallet 1 can be moved backward by the pitch distance.

As described above, in the dispensing apparatus of the embodiment, many containers 2 can be stocked in a small area and a plurality of containers 2 can be transported together by the pallet 1. In the pouring section, the respective containers 2 are transported by the pitch distance. Thus, a large number of the containers 2 can be treated in a very small area by transporting the containers 2 in the longitudinal direction in the pouring section 4 and in the transverse direction in the supply section 5 and discharge section 6. Accordingly, the operational efficiency of the material dispensing apparatus is favorable.

Figure 8:
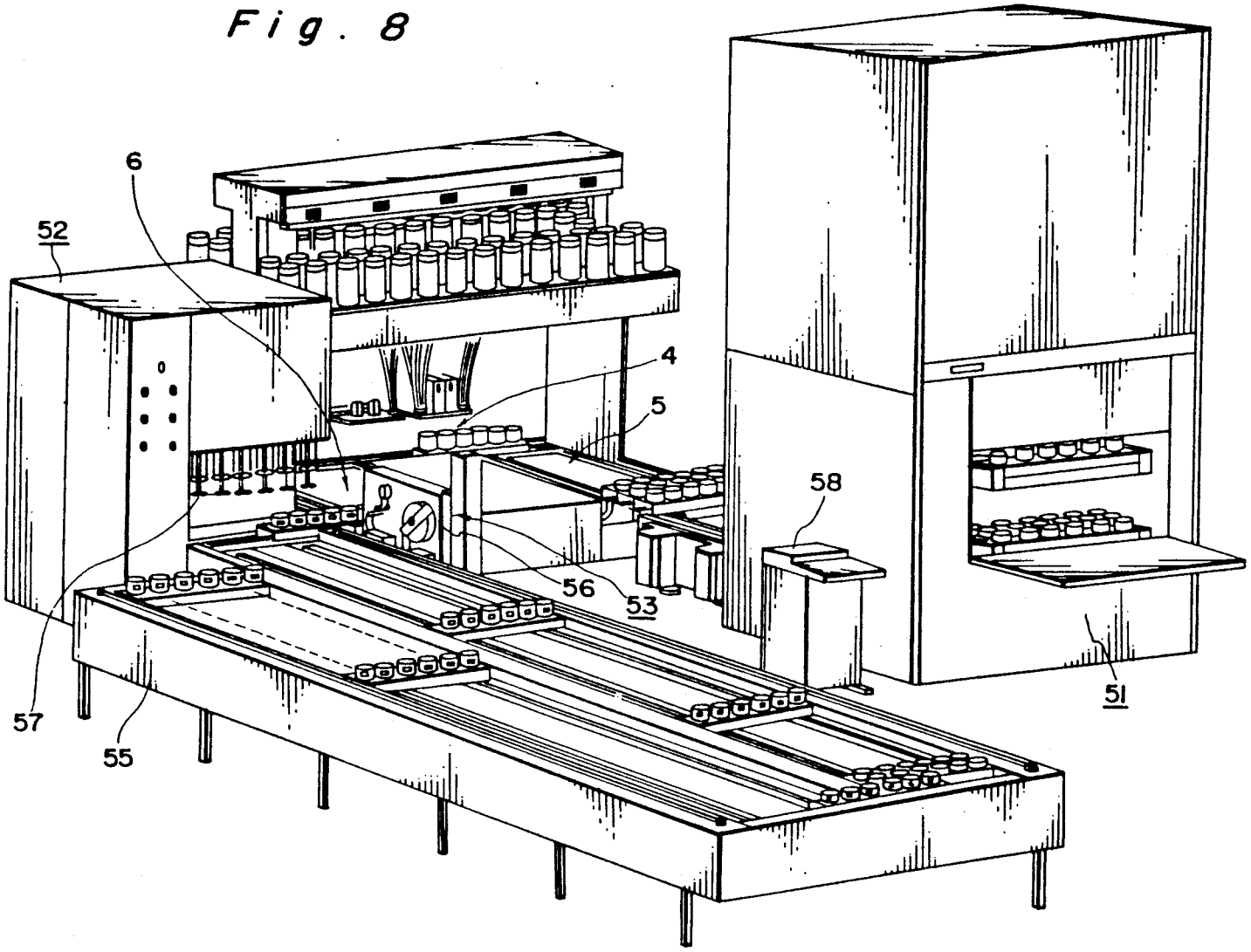
FIG. 8 is a perspective view showing schematically a dispensing apparatus of a second embodiment in accordance with the present invention.

FIG. 8 is a perspective view showing the dispensing apparatus in accordance with a second embodiment of the present invention. In addition to the equipment of the first embodiment, the dispensing apparatus of the second embodiment comprises a stock section 51 for storing a large number of empty containers, a stirring section 52 for stirring materials, and an indication section 53 for applying labels indicating classifications such as the kind of materials and the weights thereof, and a longer pallet transporting path. That is, the apparatus of the second embodiment is compact and capable of automatically intensively carrying out all the processes for mixing materials.

According to the second embodiment, the stock section 51 is provided in front of the supply section 5. The stock section 51 allows the pallet 1 to move in three dimensions in order to increase the storage efficiency. That is, a plurality of pallets 1 can be vertically and circularly moved in the stock section 51 while they are supported horizontally. The pallets 1 carrying the containers 2 are put into the stock section 51 from the front thereof and are fed out of the stock section 51 from the back thereof to the supply section 5 according to the number of containers 2 to be treated in the pouring section 4. Three rows of containers 2 held by one pallet 1 are simultaneously fed from the stock section 51 to the supply section 5. The apparatus comprises the indication section 53 and the stirring section 52 provided in the transporting path 3 which is much longer than that of the apparatus according to the first embodiment. In the indication section 53, a label printer 56 is disposed at a termination portion which corresponds to the discharge section 6 of the first embodiment. The label printer 56 prints information such as the kind and weight of materials on labels and applies the labels on the containers 2. The pallet 1 which has passed the pouring section 4 moves in the transverse direction until the pallet 1 arrives at the indication section 53. While the containers 2 intermittently move by the pitch distance in the longitudinal direction in the indication section 53, labels on which information has been printed are sequentially applied to each of the containers 2. Then, the containers 2 arrive at the stirring section 52. Vertically movable propeller mixers 57 are disposed in the stirring section 52 of the upper portion thereof such that the respective propeller mixers 57 coincide with the containers 2 transferred to the stirring section 52. In the stirring section 52, the propeller mixers stir the contents of the containers 2. After the contents of each container 2 are fully mixed, each propeller mixer 57 moves upward. Thereafter, the pallet 1 moves in the transverse direction. Finally, the pallet 1 is collected at the end portion of the collection section 55. The apparatus has a controller 58 for controlling the drive of the apparatus.

Although the present invention has been fully described in connection with the preferred embodiments thereof with reference to the accompanying drawings, it is to be noted that various changes and modification will be apparent to those skilled in the art. Such changes and modification are to be understood as being included within the scope of the present invention as defined by the appended claims unless they depart therefrom.

What is claimed is:

1. A container transporting apparatus for transporting and filling a plurality of containers with a plurality of materials, comprising:

an elongated pallet for carrying a predetermined number of the containers arranged in a row;

pallet transporting means for intermittently transporting said pallet in a longitudinal direction thereof, said pallet transporting means comprising a bar-shaped element with engaging means thereon for engaging said elongated pallet; and drive means for driving said pallet transporting means, said drive means comprising a first means for intermittently driving said pallet transporting means, from one horizontal position, forwardly in the longitudinal direction of said pallet by a predetermined distance corresponding to a center-to-center distance between adjacent ones of the containers carried by said pallet and back to said one horizontal position, second means for intermittently lifting said pallet transporting means to cause said engaging means thereof to engage said pallet and for intermittently lowering said pallet transporting means to cause said engaging means thereof to disengage from said pallet, and third means for selectively moving said second means between a first condition in which said first and second means cause said pallet transporting means to intermittently transport said pallet in a forward direction and a second condition in which said first and second means cause said pallet transporting means to intermittently transport said pallet in a rearward direction.

2. A container transporting apparatus as recited in claim 1, wherein said pallet includes an upper wall for carrying the containers, a lower wall having a means for engaging with said engaging means of said bar-shaped element, and a side wall connecting said upper and lower walls;

said pallet transporting means further comprises a first projection extending laterally from each side of said bar-shaped element and a second projection extending downwardly from said bar-shaped element; and said first means comprises an actuation means for engaging said second projection so as to move said bar-shaped element longitudinally, a screw shaft operatively connected to said actuation means for moving said actuation means longitudinally, and motor means for reversibly rotating said screw shaft so as to reciprocate said actuation means.

3. A container transporting apparatus as recited in claim 2, wherein said second means comprises a pair of guide groove members mounted, respectively, on each lateral side of said bar-shaped element, each of said guide groove members having a guide groove formed therein for receipt of a respective one of said first projections of said bar-shaped element, a partition wall mounted to extend longitudinally within each of said guide grooves to define an upper section and a lower section therein, and a pivot means mounted at each longitudinal end of each of said partition walls, for pivoting up and down about a horizontal transverse axis so that said first projections are respectively caused to move longitudinally along said upper sections of said guide grooves, respectively, when moved in one longitudinal direction and to move longitudinally along said lower sections of said guide grooves, respectively, when moved in the other longitudinal direction.

4. A dispensing apparatus for transporting and filling a plurality of containers with a plurality of materials, comprising:

a plurality of elongated pallets, each of which is adapted to carry a predetermined number of the containers arranged in a row;

a stock section comprising means for horizontally supporting and sequentially moving said plurality of pallets in three dimensions;

a supply section mounted adjacent said stock section and comprising supply means for transporting each of said plurality of pallets carrying the predetermined number of containers in a direction transverse to the longitudinal direction of said pallets;

a pouring section, mounted adjacent said supply section, comprising transporting means for intermittently moving each of said pallets in a longitudinal direction thereof away from said supply means by a predetermined distance corresponding to a center-to-center distance between adjacent ones of the containers carried by said pallets, and pouring means for pouring the plurality of materials into each of said plurality of containers at predetermined stop positions during the intermittent movement of the pallets by said transporting means;

a discharge section mounted adjacent said pouring section and comprising discharge means, for transporting each of said pallets away from said pouring section in a direction transverse to the longitudinal direction of said pallets after the predetermined number of containers carried be each of the pallets have each had the plurality of materials poured thereinto;

an indication section mounted adjacent said discharge section and comprising means for indicating on each of the containers a designation corresponding to the plurality of materials poured thereinto; and a stirring section mounted adjacent said indication section and comprising means for stirring the plurality of materials poured into each of the containers.

* * * * *